US006756942B2

(12) United States Patent
Heyde

(10) Patent No.: US 6,756,942 B2
(45) Date of Patent: Jun. 29, 2004

(54) BROADBAND COMMUNICATIONS ANTENNA

(75) Inventor: Wolfgang Heyde, Herisau (CH)

(73) Assignee: Huber+Suhner AG (CH)

( * ) Notice: Subject to any disclaimer, the term of this patent is extended or adjusted under 35 U.S.C. 154(b) by 0 days.

(21) Appl. No.: 10/240,475

(22) PCT Filed: Mar. 30, 2001

(86) PCT No.: PCT/CH01/00199

§ 371 (c)(1),
(2), (4) Date: Oct. 2, 2002

(87) PCT Pub. No.: WO01/76010

PCT Pub. Date: Oct. 11, 2001

(65) Prior Publication Data

US 2003/0058169 A1 Mar. 27, 2003

(30) Foreign Application Priority Data

Apr. 4, 2000 (CH) ..... 663/00

(51) Int. Cl.[7] ..... H01Q 1/24
(52) U.S. Cl. ..... 343/700 MS; 343/789
(58) Field of Search ..... 343/700 MS, 767, 343/789, 829, 846, 872, 769, 780

(56) References Cited

U.S. PATENT DOCUMENTS 3,009,153 A * 11/1961 Masters et al. ..... 343/746
4,086,598 A * 4/1978 Bogner ..... 343/768
4,242,685 A 12/1980 Sanford
4,733,245 A * 3/1988 Mussler ..... 343/769
4,888,597 A * 12/1989 Rebiez et al. ..... 343/778
6,486,847 B1 * 11/2002 Yamamoto et al. ..... 343/789
6,567,053 B1 * 5/2003 Yablonovitch et al. ..... 343/767

FOREIGN PATENT DOCUMENTS

GB 2 005 922 A 4/1979

* cited by examiner

*Primary Examiner*—Tho Phan
(74) *Attorney, Agent, or Firm*—Webb Ziesenheim Logsdon Orkin & Hanson, P.C.

(57) ABSTRACT

A broad band communications antenna includes a baseplate which has a conductive layer that includes at least one coupler opening. A stripline network is provided adjacent the conductive layer in the region of the coupler openings. At least one conductive patch is arranged opposite the baseplate. The baseplate and the patch are arranged in a conductive housing which is provided with an open side. The baseplate is arranged adjacent the bottom of the housing and therefore farthest from the open side. One or more lugs are provided on the open side of the housing for reducing the open cross-sectional surface of the housing when the open side is seen from above.

11 Claims, 1 Drawing Sheet

BROADBAND COMMUNICATIONS ANTENNA

BACKGROUND OF THE INVENTION

1. Field of the Invention

The invention relates to a broadband communications antenna having a baseplate which has a conductive layer having at least one coupling opening, with a stripline network being provided at a short distance from the conductive layer in the region of the coupling openings, with at least one conductive patch being arranged opposite the baseplate, with the baseplate and the patch being arranged in a conductive housing which has one open side, and with the baseplate being arranged closest to the housing bottom and thus furthest away from the open side.

A broadband antenna such as this is known from a report on the Ecole Polytechnique Fédérale de Lausanne, which was published under the title "SSAIP: A Cavity Backed Alternative to Broadband Communication Antennas".

2. Description of the Prior Art

Microstrip antennas are known per se, and are in widespread use. Their field of operation is restricted by their narrow bandwidth, which is a result of their resonant structure. The use of thick substrates and a number of layers to increase the bandwidth leads to a reduction in the radiation efficiency of the antennas. The prior art mentioned above proposes an antenna which has a physical height of 30 millimeters for a frequency of approximately 6 Gigahertz.

A new mobile radio standard entitled UMTS (Universal Mobile Telecommunications System) has been defined with frequencies in the band between 1920 and 2170 Megahertz. The existing GSM 1800 network is located in the frequency band between 1710 and 1880 Megahertz. It would now be desirable to specify a broadband antenna which can cover both frequency bands. The prior art is not suitable for this purpose, either in terms of its respective power levels for the two bands or in terms of its technical design, since the antenna has a physical height of more than 70 mm in this frequency band. The prior art provides a bandwidth of approximately 25% for matching with 10 dB, while in contrast a band width of more than 30% would be desirable.

Against the background of this prior art, the invention is based on the object of improving an antenna of the type mentioned initially such that this antenna allows integration of a GSM network and the UMTS network by means of a single antenna, with losses that are as low as possible.

SUMMARY OF THE INVENTION

This object is achieved in that one or more lugs are provided on the open side of the housing and reduce the size of the open cross-sectional area of the housing in a plan view of the open side.

The provision of lugs which reduce the size of the open cross section of the antenna housing allows a major increase in the bandwidth to be achieved while, in contrast, the prior art would have to increase the size of the open cross section of the antenna housing.

DETAILED DESCRIPTION OF THE PREFERRED EMBODIMENTS

Figure 1:
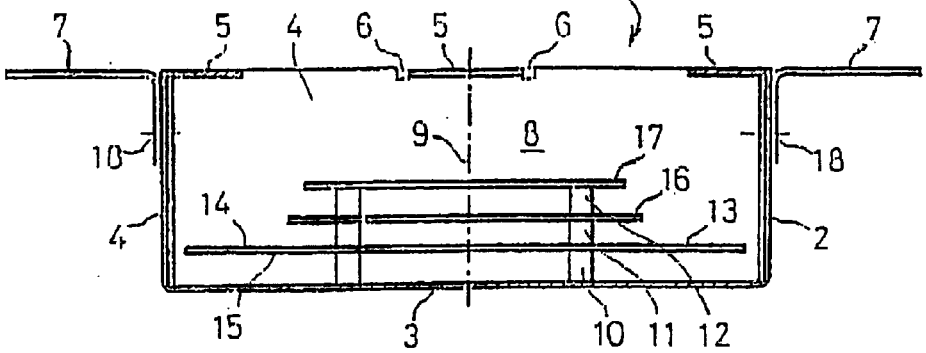
FIG. 1 shows a cross-sectional view through an antenna according to the invention.

FIG. 1 shows the cross-sectional view of an antenna 1 which is arranged in a housing 2. The housing 2 comprises a bottom 3 and four side walls 4. The housing is essentially open in the direction pointing upward in the plane of the drawing. Here, the housing 2 has four lugs 5 which are each arranged in the center of the sides and project parallel to the housing bottom 3 into the interior of the housing 2. The lugs 5 are described in more detail in FIG. 2. It can be seen from FIG. 1 that, in addition to the lugs 5, there are small rectangular grooves 6 in the side wall, so that the lugs 5 merge with a transition at the same level into the upper edge of the side walls 4.

The housing 2 is introduced between two L-shaped brackets 7 on two opposite side walls 4. The brackets 7 are connected to the housing wall via a nut and bolt connection at the point annotated by the reference symbol 18. Instead of this detachable connection, whose advantage will be explained further below, it is alternatively possible to provide an adhesive bond or some other firm connection. The housing is designed to be conductive, in the same way as the lugs 5 which are integrally connected to it. In another embodiment, the lugs 5 may also, for example, be mounted on the housing walls 4 via a bracket, in which case there must be a conductive connection between the housing walls 4 and the lugs 5.

The housing 2 forms a cavity 8 which is filled with ambient air and which, in the illustrated case, is designed to be symmetrical with respect to the center plane 9. The housing 2 is essentially open at the top except for the lugs 5, of which there are four here, in each case arranged at the center of the side surfaces and projecting into the interior of the housing 2.

These four lugs 5, which are right-angled here, reduce the cross-sectional size symmetrically, in a plan view.

Four mounts are in this case provided on the housing bottom 3, with three segments 10, 11 and 12, which act as spacers between the housing bottom 3, the baseplate 13 (on which a conductive layer 14, which has at least one coupling opening, and a stripline network 15 are located) and two patch plates 16 and 17. The stripline network 15 may in this case be arranged opposite the patch 16 or opposite the housing bottom 3.

The area between the baseplate 13 and the patches 16, 17 which are arranged above it is filled with ambient air (permittivity 1.0). This is in contrast to the prior art from the Ecole Polytechnique Fédérale de Lausanne, which uses a substrate material with a permittivity of 2.33. The ground plane which is formed by the baseplate 13 is connected, inn non-conductive manner, to the housing 2. The arrangement of the lugs 5 an the interior of the housing 2 considerably increases the relative bandwidth of the antenna. The arrangement as illustrated in FIG. 1 allows a relative bandwidth of more than 35% to be achieved for a VSWR of two (10 dB matching). The physical height of the arrangement as shown in FIG. 1 is 36 millimeters, in contrast to 70 millimeters for the prior art, for the stated frequency band for UTMS and GSM 1800.

The horizontal 3 dB beamwidth for a vertically polarized antenna can be adjusted via the width and position of the brackets 7. If the brackets are arranged as shown in FIG. 1, the 3 dB beamwidth is 65°. If the brackets 7 are moved downward, so that they end flush with the housing bottom 3, the 3 dB beamwidth is approximately 90°. Since these are the two main 3 dB beamwidths which are used for mobile radio, a mechanical apparatus with a vertically running slot at the point 18 can be used to make it possible to move the brackets 7 in a continuously variable manner vertically thus resulting in an antenna with the 3 dB beamwidth of 65° to 90°, depending on the application. In this case, the brackets 7 need not be electrically conductively connected to the housing. One advantageous embodiment in this case is a nut and bolt connection, but any other mechanical solution which allows the height of the brackets to be adjusted is also suitable.

Figure 2:
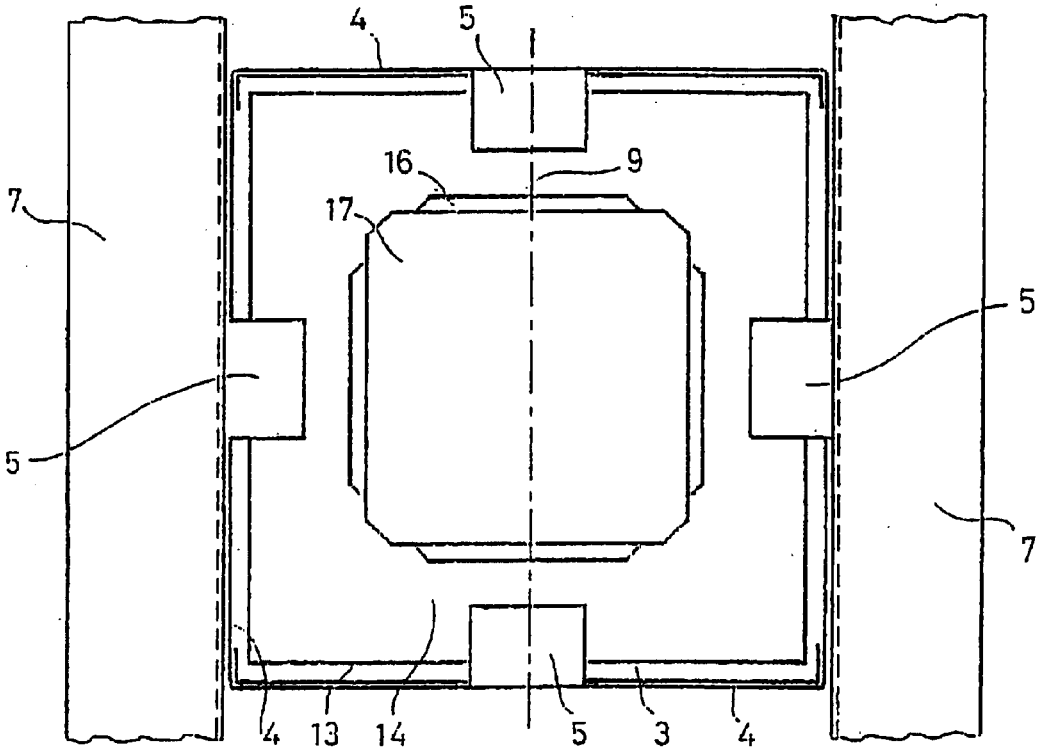
FIG. 2 shows a plan view of the antenna shown in FIG. 1.

The brackets 7 may be longer than the associated housing sides 4 of the housing 2, as is indicated in FIG. 2, in particular being twice as long. The baseplate 13 with the conductive layer 14 substantially covers the housing bottom 3 of the housing in a plan view, but with there being no conductive contact between the two elements, each of which is individually conductive.

Figure 3:
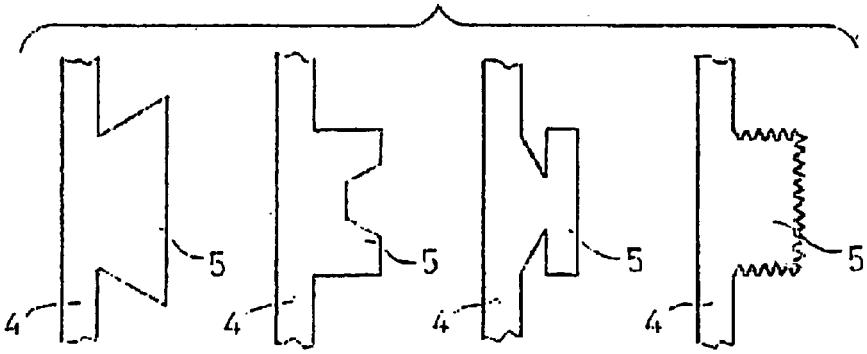
FIG. 3 shows further lug shapes for the antenna as shown in FIG. 1.

The lugs 5 are in this case designed to be parallel to the housing bottom 3, and rectangular. However, they may also have other shapes, which are illustrated in a number of embodiments in FIG. 3. For example, square or trapezoidal shapes are possible, in which case the two mutually opposite lugs 5 are preferably each designed to be the same. Four different shapes may also be chosen provided, in particular, that the respective surfaces of the lugs 5 always remain constant on each side. The lugs 5 may also be designed with curved edges, which merge continuously into one another. The lugs 5 may also be positioned at an angle to the housing bottom 3, thus projecting into the housing 2 or beyond the edges of the side walls 4. Their size is, for example, 10% of the size of a patch 16 or 17, but may also be chosen to be between 5 and 25%. The lugs 5 cover the open side 19 of the housing 2 only to the extent that they do not cover the patches 16, 17 in a plan view of the open side of the housing 2. The lugs 5 may also be recessed to the level of the upper patch 17.

In this case the housing 2 is square, but a rectangular shape is likewise possible, although the ratio of the sides should not be greater than 2:1. The patch 17 is essentially of the same size, and in this case occupies 33% of the housing cross-sectional area. The patch 16 is somewhat larger than the patch 17, but the patch 16 has corners which are cut off at the sides, so that this side edge runs under the patch 17. Other variants can likewise be used and, in particular, the patch 17 may also be larger than the patch 16.

Materials with a higher permittivity may also be used between the individual plates 14 and the patches 16, 17, for example, RF-compatible material with a permittivity of up to 10. The spaces between said elements 14, 16 and 17 may also be partially filled with a dielectric.

What is claimed is:

1. A broadband communications antenna having a baseplate which has a conductive layer having at least one coupling opening, with a stripline network being provided at a short distance from the conductive layer in the region of the coupling openings, with at least one conductive patch being arranged opposite the baseplate, with the baseplate and the patch being arranged in a conductive housing which has one open side, and with the baseplate being arranged closest to a housing bottom and thus furthest away from the open side, wherein one or more lugs are provided on the open side of the housing and reduce the size of the opening cross-sectional area of the housing in a plan view of the open side, wherein brackets are provided on two opposite sides of the housing and form a surface outside of the housing which runs parallel to the housing bottom.

2. The broadband communications antenna as claimed in claim 1, wherein:

the housing is rectangular; and a lug is arranged centrally on the side surface on each of four sides of the housing.

3. The broadband communications antenna as claimed in claim 1, wherein, when a plurality of lug is provided, the area of each lug is equal to the area of every other lug.

4. The broadband communications antenna as claimed in claim 1, wherein each lug is rectangular and runs parallel to the housing bottom.

5. The broadband communications antenna as claimed in claim 1, wherein the size of each lug does not exceed 10 percent of the size of the patch.

6. The broadband communications antenna as claimed in claim 1, wherein, when a plurality of lugs is provided, the lugs cover the open side of the housing only to such an extent that they do not cover a the patch in a plan view of the open side.

7. The broadband communications antenna as claimed in claim 1, wherein a material whose permittivity is essentially equal to 1.0 is located between the baseplate, on which the conductive layer and the stripline network are located, and the patch.

8. The broadband communications antenna as claimed in claim 1, wherein the conductive layer which is located on the baseplate substantially covers the housing bottom, without being conductively connected to the side walls of the housing.

9. The broadband communications antenna as claimed in claim 1, wherein at least one elongated hole is provided in at least one of(i) each of the two opposite sides of the housing and (ii) each bracket, through which the height of each bracket on the housing with respect to the housing bottom is settable by means of a nut and bolt connection.

10. A broadband communications antenna having a baseplate which has a conductive layer having at least one coupling opening, with a stripline network being provided at a short distance from the conductive layer in the region of the coupling openings, with at least one conductive patch being arranged opposite the baseplate, with the baseplate and the patch being arranged in a conductive housing which has one open side, and with the baseplate being arranged closest to a housing bottom and thus furthest away from the open side, wherein one or more tugs are provided on the open side of the housing and reduce the size of the opening cross-sectional area of the housing in a plan view of the open side, wherein:

the housing is rectangular;

a lug is arranged centrally on a side surface of each of four sides of the housing;

at least one elongated hole is provided in at least one of(i) each of two opposite side surfaces of the housing and (ii) each bracket provided outside the housing on two opposite side surfaces thereof, through which the height of each bracket on the housing with respect to the housing bottom is settable by means of a nut and bolt connection.

11. A broadband communications antenna having a baseplate which has a conductive layer having at least one coupling opening, with a stripline network being provided at a short distance from the conductive layer in the region of the coupling openings, with at least one conductive patch being arranged opposite the baseplate, with the baseplate and the patch being arranged in a conductive housing which has one open side, and with the baseplate being arranged closest to a housing bottom and thus furthest away from the open side, wherein one or more Jugs are provided on the open side of the housing and reduce the size of the opening cross-sectional area of the housing in a plan view of the open side, wherein:

when a plurality of lugs is provided, the area of each lug is equal to the area of every other lug;

the size of each lug does not exceed 10 percent of the size of the patch; and at least one elongated hole is provided in at least one of(i) each of two opposite side surfaces of the housing and (ii) each bracket provided outside the housing on two opposite side surfaces thereof, through which the height of each bracket on the housing with respect to the housing bottom is settable by means of a nut and bolt connection.

* * * * *

UNITED STATES PATENT AND TRADEMARK OFFICE

CERTIFICATE OF CORRECTION

PATENT NO. : 6,756,942 B2
DATED : June 29, 2004
INVENTOR(S) : Wolfgang Heyde

It is certified that error appears in the above-identified patent and that said Letters Patent is hereby corrected as shown below:

Column 3,
Line 60, “plurality of lug” should read -- plurality of lugs --

Column 4,
Line 4, “cover a the patch” should read -- cover the patch --
Lines 29 and 51, “one or more tugs” should read -- one or more lugs --

Signed and Sealed this

Twenty-sixth Day of April, 2005

JON W. DUDAS
*Director of the United States Patent and Trademark Office*